United States Patent [19]

Wilson et al.

[11] Patent Number: 4,802,436

[45] Date of Patent: Feb. 7, 1989

[54] CONTINUOUS CASTING FURNACE AND DIE SYSTEM OF MODULAR DESIGN

[75] Inventors: Robert Wilson, Dundee, Scotland; Jerry C. LaPlante, Buffalo, N.Y.

[73] Assignees: Williams Gold Refining Company, Buffalo, N.Y.; Rautomead Limited, Dundee, Scotland

[21] Appl. No.: 76,022

[22] Filed: Jul. 21, 1987

[51] Int. Cl.[4] ..... B22D 11/00

[52] U.S. Cl. ..... 164/440; 164/138

[58] Field of Search ..... 164/439, 440, 435, 437, 164/418, 138, 490; 266/236

[56] References Cited

U.S. PATENT DOCUMENTS

| | | | |
|---|---|---|---|
| 2,169,893 | 8/1939 | Crampton et al. | 164/439 |
| 2,371,604 | 3/1945 | Brennan | 164/490 |
| 3,885,922 | 5/1975 | Thomas, Jr. et al. | 428/683 |
| 3,988,176 | 10/1976 | Watanabe et al. | 148/433 |
| 3,989,548 | 11/1976 | Morris | 148/2 |
| 4,080,222 | 3/1978 | Schoerner et al. | 148/2 |
| 4,144,993 | 3/1979 | Ushio et al. | 228/127 |
| 4,175,611 | 11/1979 | Fletcher | 164/418 |
| 4,197,902 | 4/1980 | Von Jan et al. | 164/418 |
| 4,239,081 | 12/1980 | Kranz | 164/431 |
| 4,295,516 | 10/1981 | Wilson | 164/464 |
| 4,298,053 | 11/1981 | Dompas et al. | 164/429 |
| 4,377,424 | 3/1983 | Hirao et al. | 148/414 |
| 4,404,232 | 9/1983 | Evertz | 427/8 |
| 4,408,652 | 10/1983 | Ouchi et al. | 164/459 |
| 4,421,570 | 12/1983 | Gravemann | 148/11.5 C |
| 4,432,811 | 2/1984 | Stiebellehner et al. | 148/2 |
| 4,436,143 | 3/1984 | Sevastakis | 164/440 |
| 4,459,154 | 7/1984 | Wells, III et al. | 420/22 |
| 4,502,924 | 3/1985 | Minami et al. | 204/16 |
| 4,640,336 | 2/1987 | Arakawa et al. | 164/440 |

FOREIGN PATENT DOCUMENTS

| | | | |
|---|---|---|---|
| 57-64449 | 4/1982 | Japan | 164/440 |

OTHER PUBLICATIONS

The Ewencast Continuous Casting Furnace Brochure by Ewencast, I. E. Ewen & Co., Ltd., Edinburgh, 4 pps.

*Primary Examiner*—Richard K. Seidel

*Attorney, Agent, or Firm*—Christel, Bean & Linihan

[57] ABSTRACT

A continuous casting furnace (10) of modular design. The furnace is made of a crucible section (16) a feed section (18) and a die section (12). Each of these various sections are separable from the other parts, and each of these parts is in turn made up of various individual components. Thus, the crucible section includes a refractory liner (24) made of a non carbon containing material which may be disposed within a monolithic graphite crucible (22). The graphite crucible is provided with a cylindrical aperture at its bottom which receives a feed tube (30), there being a soft seal (32) between the bottom of the liner (24) and the top of the feed tube (30). The feed section and the die section are generally formed in the same manner in that there is a non carbon containing refractory tubular member (48, 64) disposed within a graphite member (50, 62). Between the feed section (18) and the die section (12) is a soft seal (66). The soft seals (34, 66) are formed of a soft felt or the like fabricated from aluminum oxide, zirconium oxide or other suitable fibers which may be impregnated with a boron nitride slurry. The various parts are held together using conventional fastening means.

27 Claims, 4 Drawing Sheets

10
12
14
16
18
20
22
24
26
28
30
32
34
36
38
40
42
44
46
48
50
52
54
56
58
60
62
64
66
68
70
72
74
76
78
2
3

62
64
62b
64c
70
74
62c
62b
64c
7
7
64b
62a
64a
80
66b
66c
66a
48b
28
24
5
6
30
6
34
26
50
48a
5
48b
48a
50
48b
50

CONTINUOUS CASTING FURNACE AND DIE SYSTEM OF MODULAR DESIGN

TECHNICAL FIELD

This invention relates to continuous casting furnaces and to dies suitable for use in the continuous casting of high melting temperature metals such as: iron, nickel, nickel-chromium, palladium, platinum and cobalt. More particularly, the present invention relates to vertical and horizontal continuous casting furnaces and dies made of a modular construction wherein the crucible section, the feed section and the die section are each separable from each other and each of these sections is in turn made up of various individual components.

BACKGROUND OF THE INVENTION

Continuous casting is a well known method for converting liquid metals into solid materials of constant cross-section in continuous or semi-continuous lengths, convenient for use as cast or suitable to further forming by well known metal working procedures.

Equipment for continuous casting is well known in the metals industry. Several schemes are in common usage. For the casting of relatively low melting metals and alloys, (below a melting point of about 1200° C.) a type of system using solid crucibles and dies is often used.

In this system the solid crucible is usually constructed of graphite. The metal may be introduced as solid alloy or components and melted directly in the crucible, or may be added as molten metal from an exterior melting and/or alloying source.

The crucible is generally maintained at some temperature above the metal melting point via externally applied heat, as by induction, electrical resistance heaters, gas flames, or other means well known in the industry, and is connected with an orifice or feed section that allows molten metal to flow into a casting die. The die is most often machined from graphite, and is held tightly in contact with, inserted in, or in some fashion attached to the orifice or feed section so as to form a leak proof seal.

The die can be placed at an angle, generally 90°, to the crucible, in which case the method of casting is referred to as "horizontal" casting, or may be placed below the crucible, in which case the method of casting is referred to as "vertical" casting.

Molten metal feeds by gravity and/or pressure through the feed section and freezes to solid metal at some point. Freezing is controlled by cooling devices such as water cooled plate coolers, attached or pressed against the outer surface of the die or adjustable water or gas cooling R.W. 7 July 1987 by 15 July 87 probes, disposed in the die. Casting is accomplished in a continuous manner by withdrawing the solidified metal via some withdrawal mechanism.

Silver, gold, copper, and aluminum and their alloys are commonly produced by both horizontal and vertical casting, using graphite dies and crucibles. A die used in such a furnace is shown in U.S. Pat. No. 4,295,516, the furnace being of a small size suitable for installations in existing facilities.

It is desirable to produce other alloys by the continuous casting process, most particularly, for instance, alloys based on nickel (Ni), nickel-chromium (NiCr), palladium (Pd), platinum (Pt), iron (Fe) and cobalt (Co). However, it is not possible to use a graphite die and particularly graphite crucible systems for these alloys, as they all readily dissolve carbon (graphite). This dissolution not only changes the properties of the metals; it erodes the crucible and die, rendering them almost immediately unusable and ultimately resulting in metal leaking through the system, producing a partial or total metal loss into the heating portion of the melting system.

U.S. Pat. No. 4,175,611 discloses plasma coating graphite dies with various materials for use when casting the above materials, which various materials may improve the wearing characteristics of the die.

DISCLOSURE OF THE INVENTION

This invention overcomes the problems associated with the continuous casting of alloys of Ni, NiCr, Pd, Pt, Fe, and Co in graphite systems, by use of modular lining components that are resistant to dissolution and/or erosion by the contained metals. A graphite holding system may be used for the furnace or die if it is properly isolated from the metals in question. This can be done using non carbon containing refractory materials such as known refractory ceramics, which are not subject to attack by the metal. Representative materials include aluminum oxide, magnesium oxide, zirconium oxide, calcium oxide, beryllium oxide, aluminum nitride, boron nitride and titanium boride (titanium diboride). It will be understood that various combinations of these compounds and/or these compounds with small additions of other materials as "binders" are included within the scope of this invention.

In accordance with the present invention there is provided a continuous casting furnace for use with metals capable of disolving carbon, the furnace comprising a crucible assembly provided with a graphite crucible and a graphite feed housing, a non-carbon refractory liner disposed within the graphite crucible, and a feed tube system formed of non-carbon refractory material, the feed tube system extending substantially from the liner through the crucible assembly; a die section including a tubular graphite die carrier, and a non-wetting non-carbon refractory die disposed within the tubular graphite die carrier; flexible sealing means extending between the die section and the crucible assembly; and holding means capable of holding the parts together in juxtaposition relationship.

Thus, in accord with one form of the present invention there is provided a continuous casting furnace made up of three distinct sections, namely an upper or crucible section, a lower or feed section, and a die section. Each section includes a graphite holding system and refractory inserts or liners. These inserts are in turn made of an appropriate non carbon containing refractory material which is not subject to attack by the particular metal or metal alloy system being cast.

The above will become more apparent from a consideration of the following detailed description taken in conjunction with the accompanying drawings in which the preferred embodiments of this invention are illustrated.

DETAILED DESCRIPTION

Figures 1, 2:
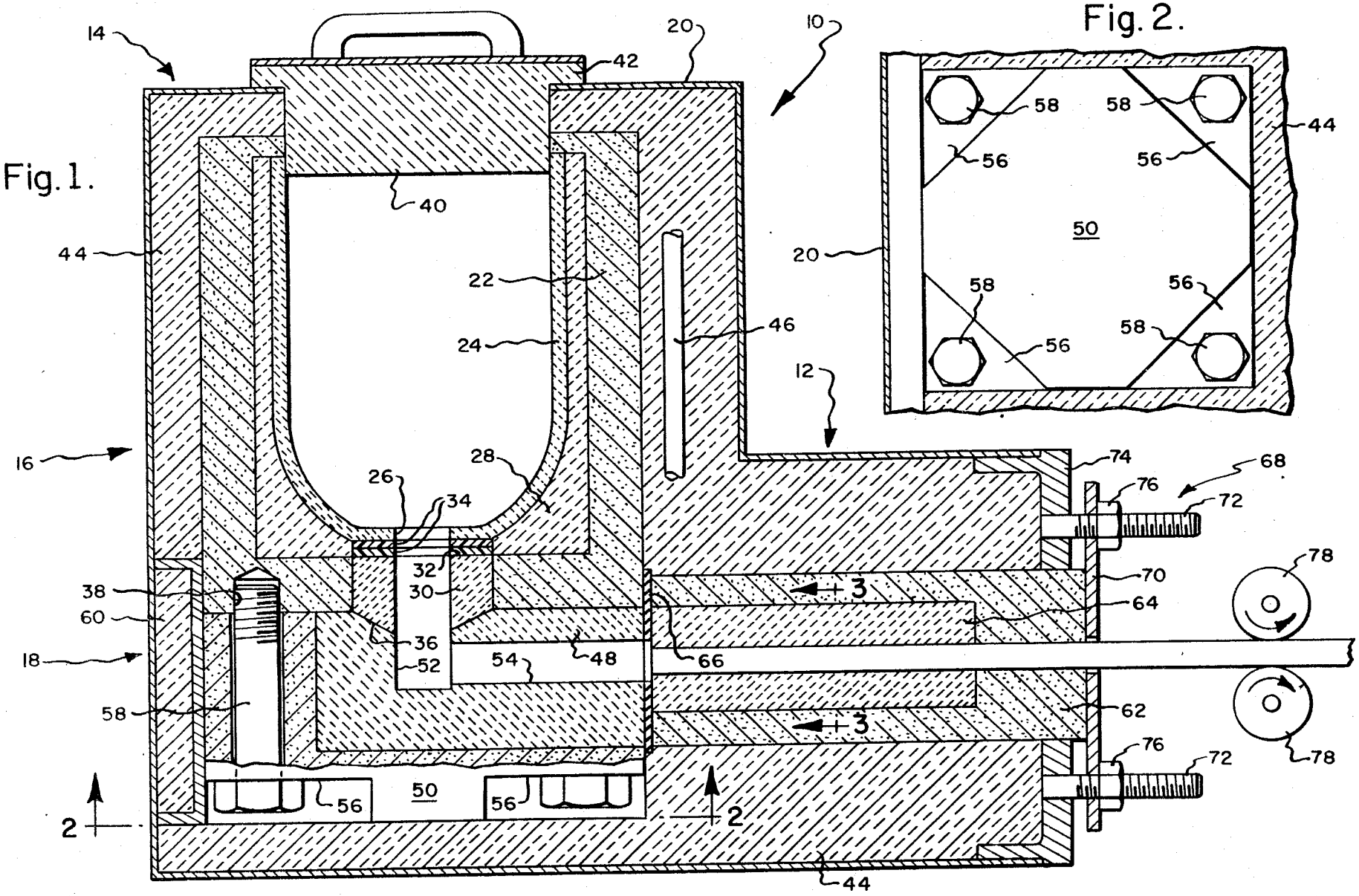
FIG. 1 is a section view through a first embodiment of the continuous casting furnace of this invention.
FIGS. 2 and 3 are sections taken generally along the lines 2—2 and 3—3 in FIG. 1.

Referring first to FIG. 1, a first embodiment of the continuous casting furnace of this invention is illustrated, the furnace being indicated generally at 10. The furnace includes a die section indicated generally at 12, and a crucible assembly indicated generally at 14, the crucible assembly in turn being made up of a crucible section indicated generally at 16, and a feed section indicated generally at 18. The entire furnace is disposed within a metal housing 20.

The crucible section 16 includes a monolithic graphite crucible 22 provided with a suitable cylindrical aperture or orifice at its lower end. Disposed within the monolithic graphite crucible 22 is a refractory liner 24. The refractory liner is preferably made of a non carbon containing material such as aluminum oxide, with or without binders. However, it could also be made of other suitable materials such as magnesium oxide, zirconium oxide, calcium oxide, beryllium oxide, aluminum nitride, and boron nitride. The actual selection of the liner material will depend upon the material being melted within the furnace, costs and availability.

It should be noted that the preferred refractory material may not be the same for crucible and die. For example when the metal to be cast is palladium, nickel-chromium, nickel, or an alloy having a high nickel content, the crucible liner will preferably be made out of aluminum oxide, zirconium oxide or magnesium oxide. The liner for the die in casting the palladium or nickel-chromium alloy could be made of either beryllium oxide or boron nitride. However, the liner for nickel alloys would be preferably beryllium oxide.

As can be seen from FIG. 1, the refractory liner is provided with an orifice 26, which orifice is concentric with the cylindrical aperture in the graphite crucible 22. The liner may bear directly against the walls of the graphite crucible, or alternatively it may be supported by a suitable refractory cement 28. A feed tube system extends from the orifice in the liner, the feed tube system including an open feed tube 30 disposed within the cylindrical orifice within the graphite crucible, the feed tube also being made of a suitable refractory material other than graphite. The outer diameter of the feed tube is properly sized with respect to the orifice in the graphite crucible so that there will be as little clearance as possible between the parts and which will still permit disassembly of the feed tube from the crucible. Disposed between the top surface of feed tube 32 and the bottom of the liner 24 is a flexible or soft seal 34. The soft seal is so designed that it will maintain a fluid tight relationship between the liner 24 and the top surface of the feed tube 30 and yet will permit thermal expansion of one part with respect to the other as is more fully brought out below. The bottom of the feed tube 30 is provided with a conical surface 36. Although the four corners of the bottom of the graphite crucible are depicted as having threaded apertures 38, any sutiable fastening or positioning device will do such as a peg, wedge, etc. The top of the liner 24 may be closed by any suitable closure 40. The closure could be a spring loaded plate. Optionally, it may be held in place by gravity. Closure 40 is shown as having a flange 42 which rests upon the metal housing 20. Surrounding the sides and the top of the crucible 22 may be suitable insulation 44. The thickness of the insulation may vary considerably from that shown in FIG. 1. In addition, a suitable heating element, a portion of one being indicated at 46, is disposed about crucible 22 for the purpose of heating and maintaining the contents of the crucible in a liquid stage. Any known heating apparatus will suffice including standard gas, electric or induction heating elements.

The feed section 18 includes a tubular feed system 48, which forms the feed tube system 30. In the embodiment shown in FIG. 1 the tubular feed system is formed from a single piece of machined refractory material, such as boron nitride. The tubular feed system 48 is in turn is supported within a monolithic graphite feed housing 50, the parts 48 and 50 being so machined that they will closely interfit each other. As can be seen from FIG. 1 the tubular feed system has a vertically extended aperture 52 and horizontal aperture 54 which intersects the lower end of the vertical aperture 52. This form of design is called a horizontal casting continuous furnace. However, it should be noted that the aperture 52 could extend downwardly to the housing and that the die section 12 could be disposed below the feed section, in which case the furnace would be referred to as a vertical casting continuous furnace. Many of the principles of this invention are applicable to both vertical and horizontal continuous casting furnaces.

Vertical aperture 52 is shown in the drawing figure as being provided with a top bevel edge which meets with the bottom bevel edge 36 of the feed tube 30. Although this configuration is preferred, flat mating surfaces may also be employed where the feed tube 30 meets the tubular feed system 48. The feed tube 30 as well as the tubular feed system 48 are preferably formed of the same materials so that they will have the same rate of thermal expansion and contraction and therefore will maintain a tight seal adjacent to the machined meeting surfaces.

Graphite holding means are provided to hold graphite crucible 22 and the graphite feed housing 50 together in juxtapositioned relationship at all times so that the lower end of the feed tube will be maintained in contact with one end of the tubular feed system. To this end, triangular corners 56 are machined out of the lower surface of the feed housing 50 and suitable vertical apertures are provided therein, which vertical apertures are in concentrical alignment with the threaded apertures 38 in the crucible 22. Bolts 58, which are formed of graphite, are then passed through the apertures and snuggly secured within the threaded apertures 38 to maintain the parts together. The sides and the bottom of the feed housing 50 are also surrounded by suitable insulation 44 although one side of the feed housing 50 will abut against a stop 60 or the purposes which will be brought out below. Again, although graphite threaded bolts are depicted, any known suitable internal or external holding means may be substituted for the threaded system.

The die section includes as its principal component a graphite die carrier 62 and a tubular die 64 formed of a non carbon refractory material. In the embodiment illustrated in FIG. 1 the graphite die carrier is formed from a single piece of machined monolithic graphite. A suitable cavity is machined within the graphite die carrier 62 and the tubular die is inserted therein. It should be noted that the tubular die need not extend the full length of the die carrier, it only being needed for that portion of the length of the die carrier wherein the metal being cast may be still in liquid form. However, once the metal being cast has been transformed to a solid, it will no longer dissolve the graphite and thus that portion of the graphite die carrier which surrounds solid metal need not be provided with the tubular die 64, the tubular die being of a non carbon refractory material which is not wet by the metal being cast.

Some of the refractory materials may be "wet" by the metal being cast, but not eroded by it. Such a refractory is suitable for containing the liquid metal, but is not suitable as a "casting" surface in the die. In this regard, it should be noted that if the metal wets the die surface it will adhere to the surface as it freezes, causing the solidified metal or die to be torn apart as the solidified metal is withdrawn from the die section, rendering it unusable.

A soft seal 66 is disposed between the graphite die carrier and the tubular die on one side and the graphite feed housing and the crucible on the other side. Holding means, indicated generally at 68, are provided to maintain the parts together in their dèsired assembled relationship. The holding means includes a metal plate 70 which is passed over studs 72 carried by one end 74 of the metal housing 20, the metal palte being brought to bear against the end of the graphite die carrier remote from the feed section by nuts 76. When the nuts are brought down to bear onto the metal plate it will tend to force the graphite carrier to the left as viewed in FIG. 1 bearing in turn against the soft seal, shifting movement of the graphite feed housing 50 to the left being prevented by stop 60. It should be noted that the metal plate will be provided with a suitable aperture for the passage of the metal which is being cast. As the metal is being cast it is caused to be brought out of the furnace by rollers 78 which are of conventional construction. Disposed about graphite die carrier is insulation 44.

While not shown in FIG. 1 the graphite die carrier is preferably provided with cooling means of the type shown U.S. Pat. No. 4,295,516, the subject matter which is incorporated herein by reference thereto. In addition, the graphite die carrier may further be provided with a thermocouple as is well known in the art. The cross section of the die may be of any desired configuration and in the embodiment shown in FIG. 1 it is of a rectangular cross section.

It can be seen that the design shown in FIG. 1 is of rather simple construction requiring neither difficult casting nor machining of the parts to produce the desired apparatus. In addition, by using interchangeable liners, tubular feed systems, and dies many differing materials may be produced in the furnace of this invention.

Figures 3, 4, 5, 6, 7:
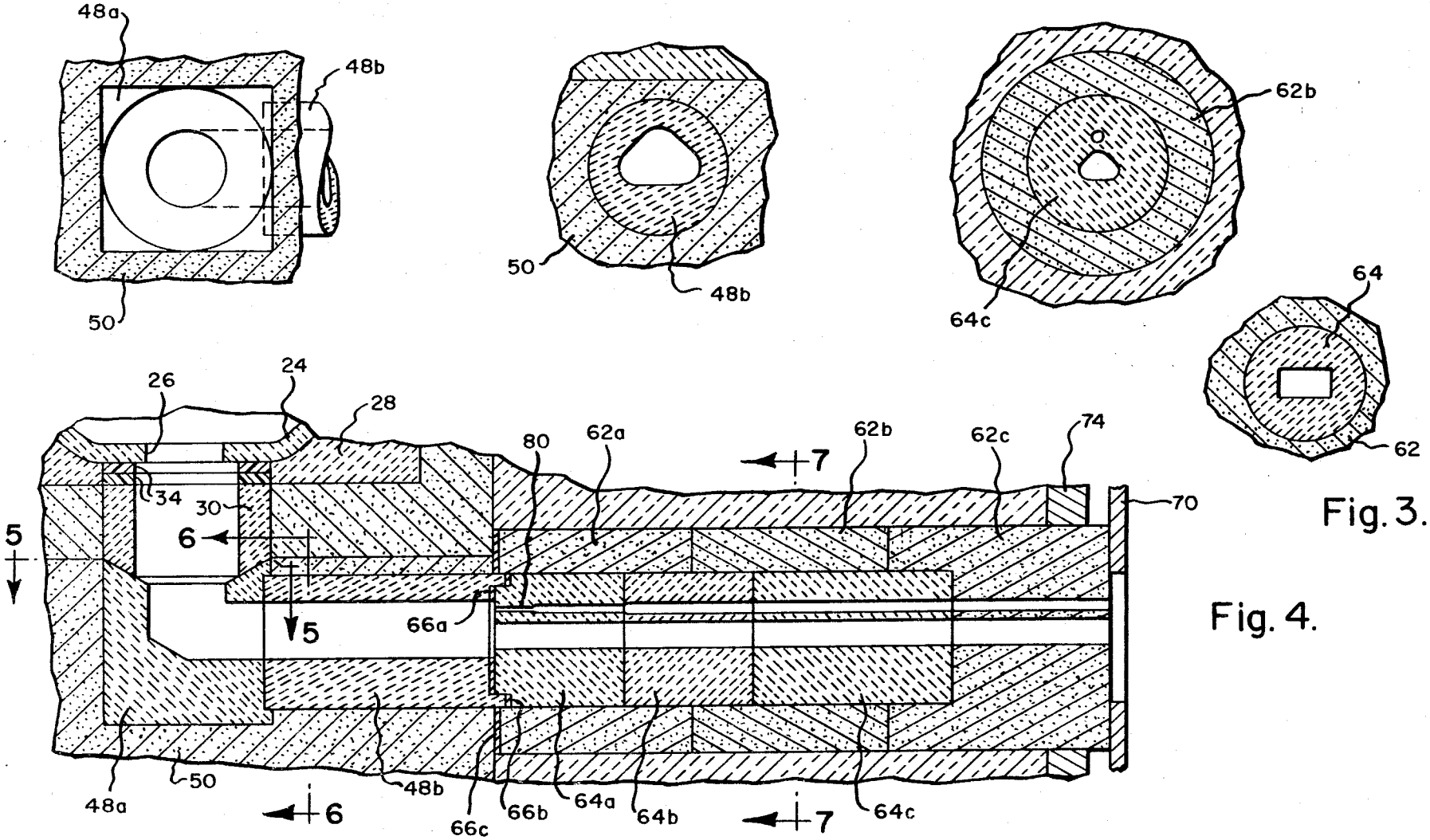
FIG. 4 is a partial sectional view of a second embodiment of this invention.
FIGS. 5, 6 and 7 are sectional views taken generally along the lines 5—5 6—6, and 7—7 in FIG. 4.
Figure 9:
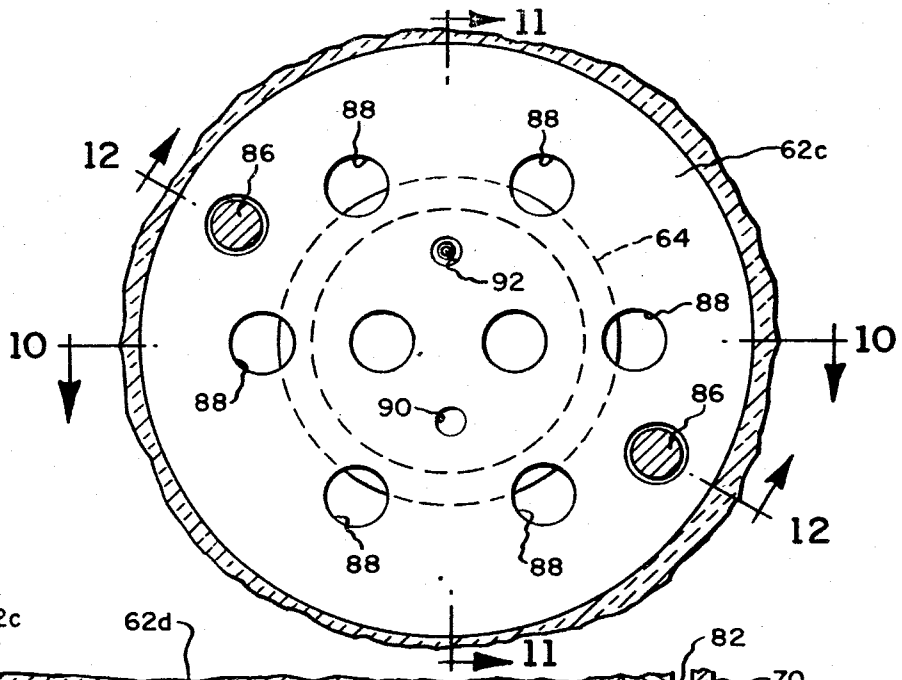
FIG. 9 is a sectional view through another form of die which may be used in a fourth modification of the present invention.

One form of the invention has been illustrated in FIGS. 1 through 3. Another form is illustrated in FIGS. 4 through 7. In the design shown in FIGS. 4 through 7, a somewhat different construction of feed section and die section is shown. In this design a two section tubular feed system may be utilized, the first section being a generally square block 48a which is suitably machined to provide intersecting passageways for the flow of metal from the crucible to the die. The feed system further includes a tubular member 48*b* which abuts one surface of the square block 48*a* to provide a liquid tight passageway. The tubular portion is in turn received within a tubular hole drilled within the monolithic graphite feed housing 50 of this figure. A soft seal of the same type as is shown in FIG. 1 is provided between the upper end of feed tube 30 and the lower end of liner 24. The die section in FIGS. 4 through 7 is formed of discrete graphite die carriers and tubular die sections, the parting lines of which are not coextensive with each other as can been seen from the FIG. 4. Thus, the graphite die carrier in this embodiment is formed of three discrete sections 62*a*, 62*b*, and 62*c* and the tubular die is also formed of three sections 64*a*, 64*b* and 64*c*. In addition, an orifice 80 is provided through the tubular refractory dies 64, the orifice terminating within the aperture within the tubular portion 48*b*. The purpose of the orifice 80 is to introduce an inert gas, such as dry nitrogen, into the liquid metals for the purpose of flushing away undesirable gases and also for the purpose of agitating the metals as they are being maintained within the crucible. While not shown in FIGS. 4 through 7 the graphite sections 62*a–c* may be held together by suitable graphite bolts or other means. In addition, cooling means and thermolcouples are also provided. Concentric annular soft seals 66*a*, 66*b*, and 66*c* are provided as shown in FIG. 4.

Figure 8:
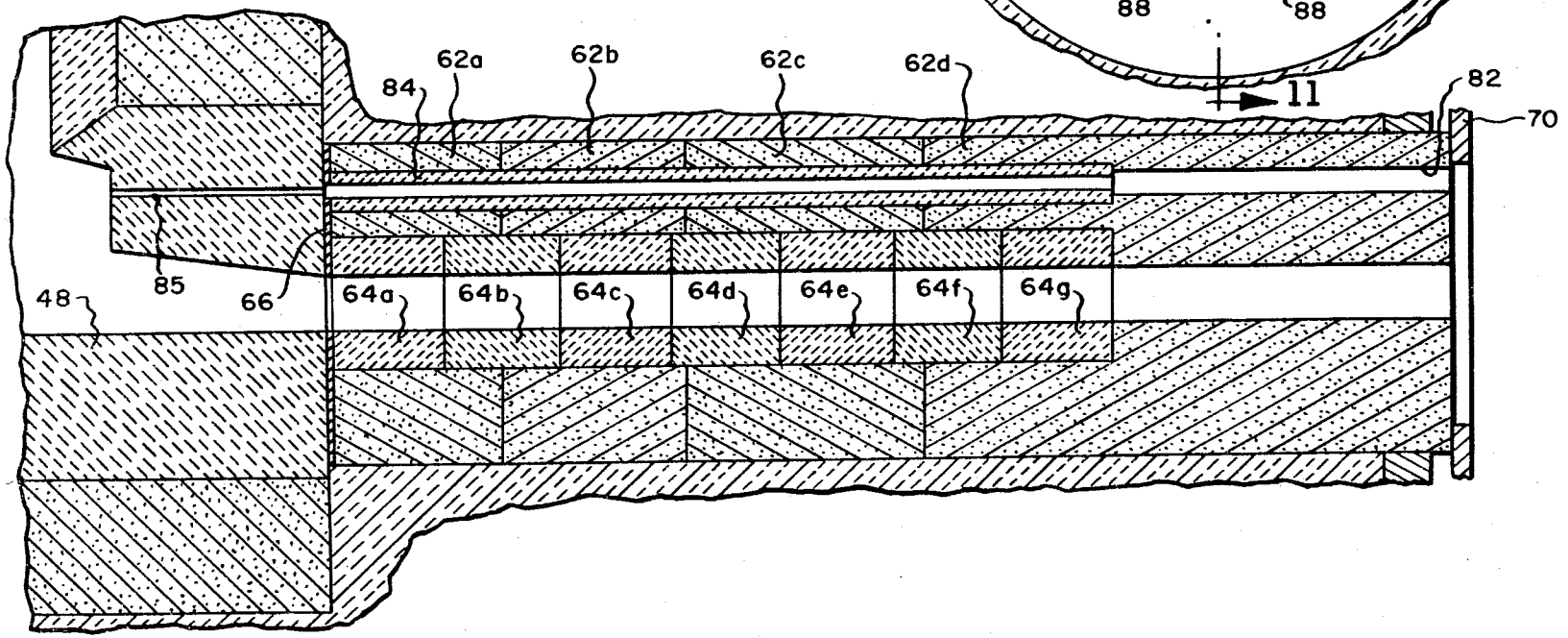
FIG. 8 is a partial sectional view of a third embodiment of the present invention.
Figure 10:
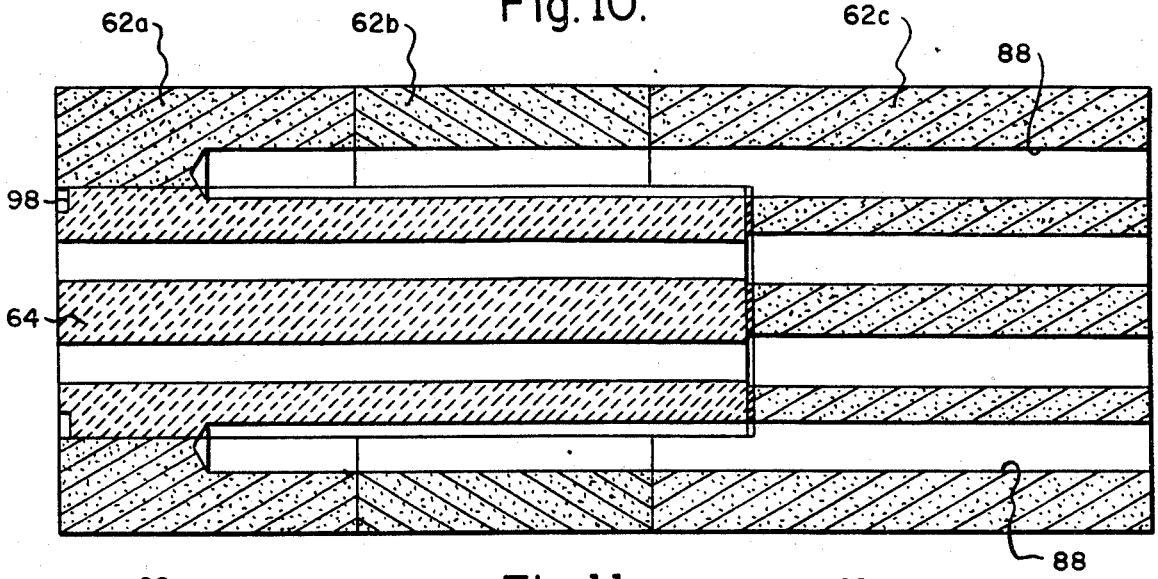
FIGS. 10, 11 and 12 are sectional views taken generally along the lines 10—10, 11—11 and 12—12 in FIG. 9.
Figure 11:
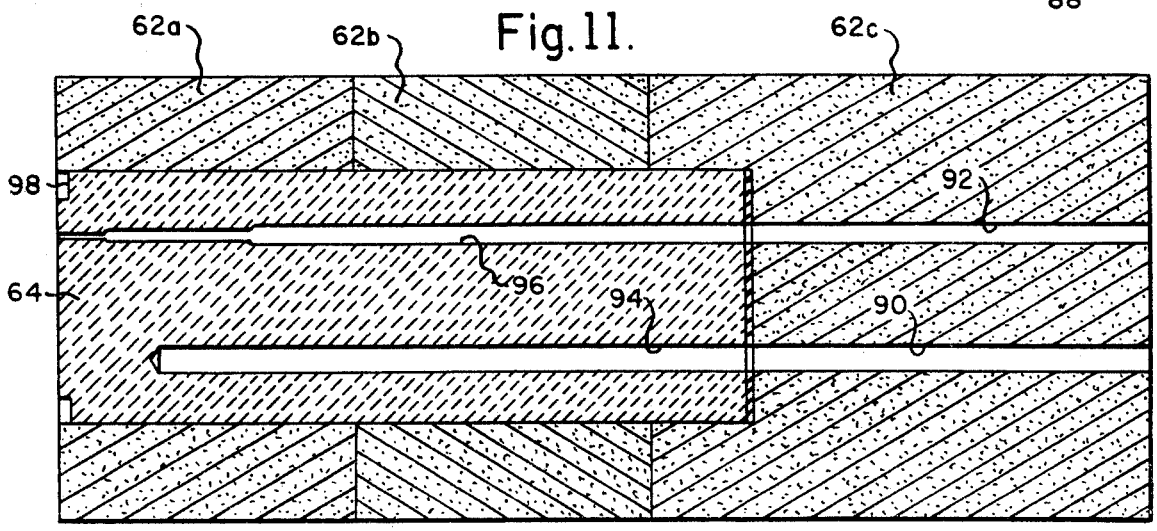
Figure 12:
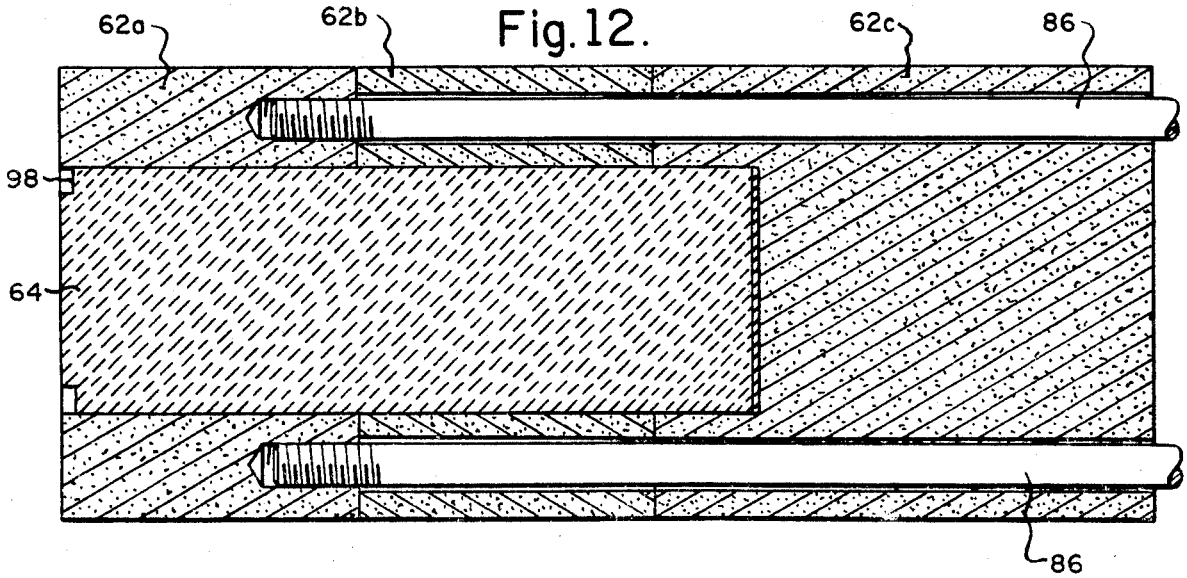

The design shown in FIG. 8 differs from the preceding designs in that a signle unitary graphite feed housing is utilized, as in the design of FIG. 1 and a multiple section die carrier and die are illustrated as shown in FIGS. 4 through 7. In addition, because of the differing geometry it is not possible to have the bubbler orifice 80 terminate at the junction of the left hand die section 64a R.W. 7 July 1987 by 15 July 1987 and the feed tube within the tubular feed system adjacent to the die. Therefore, in this design the graphite sections are provided with a cylindrical bore 82, an enlarged portion of which receive a refractory bubbler tube 84 which extends through the various sections 62*a–62d* of the sectional graphite die carrier. The refractory bubbler tube 84 abuts against the outer surface of the tubular feed system 48, which tubular feed system is provided with a further cylindrical aperture 85 for the passage of inert gases. A single soft seal 66 is utilized in this design, the seal being provided with an additional orifice (no number) for the passage of inert gasses.

FIGS. 9–12 show a further die design which may be utilized for casting simultaneously two separate rods. In this design a multiple section die carrier 62*a–c* is utilized however only a single die 64 is provided. The graphite die carriers 62*a–c* are held together by suitable graphite bolts 86 and suitable apertures 88 are provided for the reception of cooling means. An aperture 90 is provided for the reception of a thermocouple. In addition, a further aperture 92 is provided for the passage of inert gasses. The apertures 90 and 92 are only within the right hand section 62*c* of the sectional graphite die carrier and are concentric with further apertures 94 and 96 within the die 64. In this design the graphite die carrier will abut against a graphite feed housing and crucible, as shown in FIG. 1 and it is only necessary to provide a soft seal within the annular cavity 98.

An important consideration in using a graphite crucible and die system with refractory linings is the difference in thermal expansion between materials. Allowance must be made for differential dimensional changes that occur between the components. If this is not done, cracking of the components may occur due to large stresses caused by one component expanding more than another. Conversely, if too much allowance is made, the components will not mate properly, allowing molten metal to leak through to the graphite, causing adverse reactions and possible destruction of the holder and/or die.

This may be prevented by use of "soft" or flexible refractory seals or washers which compress during heating. The use of flexible sealing means 34, between crucible liner 24 and feed tube 30 allows the use of different crucible and feed tube materials. In the case of the feed tube 30 being fabricated out of an expensive material like boron nitride, a much less expensive material, e.g., aluminum oxide, would then be preferred for the crucible liner 24. However, aluminum oxide has a much higher expansion rate.

Similarly, the use of flexible sealing means 66 between die 64 and feed section 48 is desirable to keep die holder 62 and die 64 under pressure against feed section 48.

The use of a soft or flexible sealing means will preferably be required wherein it is desirable to allow for expansion differences between parts, to maintain a leak proof seal or to prevent excessive compression forces.

Flexible sealing means 34 and 66 are preferably made of aluminum oxide or zirconium oxide fibers fabricated into a paper, cloth or felt-like "soft" consistency. Although aluminum oxide is preferred, any suitable non carbon containing refractory fibrous material may be utilized provided it does not melt within the operating temperature range of the furnace. The seals may optionally be impregnated with a boron nitride paste or slurry to improve their flexibility and sealing ability. The boron nitride paste or slurry prevents sintering and/or hardening of the flexible sealing means at elevated temperatures, (i.e. above about 1100° C.) thereby maintaining the soft consistency of the seal or washer.

Suitable boron paste is available commercially from ZYP Coatings Incorporated sold under the name "TYPE BN PAINT" or from SOHIO under the designation "BN NITRIDE COATING."

While preferred structures in which the principles of the present invention have been incorporated are shown and described above, it is to be understood that this invention is not to be limited in the particular details shown and described above, but that, in fact, widely differing means may be employed in the broader aspects of this invention.

What is claimed is:

1. A continuous casting furnace for use with metals capable of dissolving carbon, the furnace being of a modular construction utilizing a graphite metal containment system lined with suitable non carbon containing refractory materials; said furnace comprising:

a crucible assembly provided with a graphite crucible, and a refractory liner supported within the graphite crucible;

a die section including a tubular graphite die carrier, and a non-wetting refractory die disposed within the tubular graphite die carrier;

flexible sealing means extending between the die section and the crucible assembly; and holding means capable of holding the parts together in juxtapositioned relationship.

2. The continuous casting furnace as set forth in claim 1 wherein the crucible assembly includes a crucible section including the graphite crucible and the refractory liner, and further including a downwardly extending open feed tube, and a feed section including a graphite feed disposed below the crucible section, the graphite feed being provided with a tubular feed system, and graphite holding means to hold the graphite crucible and the graphite feed together in juxtapositioned relationship with the lower end of the feed tube being in contact with one end of the tubular feed system.

3. The continuous casting furnace as set forth in claim 2 wherein the graphite feed is monolithic and the tubular feed system is formed of a non carbon containing refractory inorganic material.

4. The continuous casting furnace as set forth in claim 2 wherein the graphite crucible is monolithic and the feed tube is formed of a non carbon containing refractory material and wherein the graphite feed is monolithic and the tubular feed system is formed of a non carbon containing refractory material, and wherein the lower end of the open feed tube and the upper end of the tubular feed system are provided with mating beveled edges.

5. The continuous casting furnace as set forth in claim 4 wherein said tubular feed system is formed of boron nitride.

6. The continuous casting furnace as set forth in claim 1 wherein the crucible assembly further includes a feed tube system formed of a non-carbon containing refractory material.

7. The continuous casting furnace as set forthin claim 6 wherein a flexible sealing means is provided between the lower end of the refractory liner and the upper end of the feed tube system.

8. The continuous casting furnace as set forth in claim 6 wherein said feed tube system is formed of boron nitride.

9. The continuous casting furnace as set forth in claim 1 wherein the die carrier and the die are formed of discrete sections, the parting lines for the sections of the die carrier not being coextensive with the parting lines for the die.

10. The continuous casting furnace as set forth in claim 9 wherein the die section is formed of a non carbon containing refractory material.

11. The continuous casting furnace as set forth in claim 10 wherein said die is formed of boron nitride.

12. The continuous casting furnace as set forth in claim 10 wherein the flexible seal is comprised of a non carbon containing refractory material or a mixture of said materials fabricated into a paper, cloth or felt-like consistency.

13. A continuous casting furnace as set forth in claim 12 wherein the flexible sealing means is comprised of one or more non carbon containing refractory materials selected from the group consisting of aluminum oxide and zirconium oxide fabricated into a paper, cloth or felt-like consistency.

14. A continuous casting furnace as set forth in claim 13 wherein the flexible seal is impregnated with a paste or slurry comprised of boron nitride in an amount sufficient to prevent the hardening of said flexible sealing means.

15. The continuous casting furnace as set forth in claim 1 wherein said refractory liner is formed of aluminum oxide.

16. The continuous casting furnace as set forth in claim 1 wherein said refractory liner is formed of zirconium oxide.

17. A continuous casting furnace of modular design comprising:

a crucible assembly including a monolithic graphite crucible, a refractory liner supported within the crucible, and a downwardly extending open feed tube formed of a non carbon containing refractory material, the liner having an orifice in communication with said feed tube;

a feed assembly including a monolithic graphite feed portion disposed below the crucible assembly and a tubular feed system;

a die assembly including a graphite die carrier provided with a tubular die;

graphite holding means to hold the graphite crucible and the graphite feed portion together in juxtapositioned relationship with the lower end of the feed tube being in contact with one end of the tubular feed system; and additional holding means to hold one end of the graphite die carrier adjacent the graphite feed portion with the other end of the tubular feed system in alignment with one end of said tubular die.

18. The continuous casting furnace as set forth in claim 17 wherein a flexible seal is provided between the top of the feed tube and the bottom of the refractory liner.

19. The continuous casting furnace as set forth in 18 wherein the flexible seal is comprised of a non carbon containing refractory material or a mixture of said material fabricated into a paper, cloth or felt-like consistency.

20. The continuous casting furnace as set forth in 19 wherein the flexible sealing means is comprised of one or more non carbon containing refractory materials selected from the group consisting of aluminum oxide and zirconium oxide fabricated into a paper, cloth or felt-like consistency.

21. The continuous casting furnace as set forth in claim 20 wherein the flexible seal is impregnated with a paste or slurry comprised of boron nitirde in an amount sufficient to prevent the hardening of said flexible sealing means.

22. The continuous casting furnace as set forth in claim 14 wherein the tubular feed system is formed of a non carbon containing refractory material.

23. The continuous casting furnace as set forth in claim 22 wherein the lower end of the feed tube and the adjacent end of the tubular feed system are provided with mating surfaces.

24. The continuous casting furnace as set forth in claim 17 wherein the die carrier and die are formed of discrete sections, the parting lines for the sections of the die carrier not being coextensive with the parting lines of the die sections.

25. A continuous casting furnace for use with metals capable of dissolving carbon, the furnace being of a modular construction and including:

a monolithic graphite crucible provided with a non carbon containing refractory liner having an orifice at its lower end thereof, a downwardly extending open feed tube the upper end of which is in alignment with said orifice, a flexible seal between the upper end of the feed tube and the refractory liner, a monolithic graphite feed disposed below the graphite crucible, a refractory tubular feed disposed within the graphite feed, adjacent ends of the tubular feed and the feed tube being beveled, graphite holding means capable of holding the graphite crucible and the graphite feed together in juxtapositioned relationship, a die section including a graphite die carrier and a tubular die formed of a non-wetting refractory, flexible sealing means extending between the die section and the feed section, and additional means to hold one end of the graphite die carrier adjacent the outer surface of the graphite feed tube with the other end of the tubular feed in alignment with one end of said die.

26. The continuous casting furnace as set forth in claim 25 wherein the die carrier and die are formed of discrete sections, the parting lines for these sections of the die carrier not being coextensive with the parting lines for the die.

27. A continuous casting furnace for use with metals capable of dissolving carbon, the furnace being of a modular construction utilizing a graphite metal containment system lined with suitable non-carbon containing refractory materials; said furnace comprising:

a crucible assembly provided with a graphite crucible and a graphite feed housing, a non-carbon refractory liner disposed within the graphite crucible, and a feed tube system formed of a non-carbon refractory material, the feed tube system extending substantially from the liner through the crucible assembly;

a die section including a tubular graphite die carrier, and a non-wetting non-carbon refractory die disposed within the tubular graphite die carrier;

flexible sealing means extending between the die section and the crucible assembly; and holding means capable of holding the parts together in juxtaposition relationship.

* * * * *

UNITED STATES PATENT AND TRADEMARK OFFICE

CERTIFICATE OF CORRECTION

PATENT NO. : 4,802,436

DATED : February 7, 1989

INVENTOR(S) : Robert Wilson and Jerry C. LaPlante

It is certified that error appears in the above-identified patent and that said Letters Patent is hereby corrected as shown below:

Claim 7, line 1, change "forthin" to read -- forth in--.

Claim 21, line 3, change "nitirde" to read --nitride--.

Claim 22, line 2, change "14" to read --17--.

Signed and Sealed this

Twenty-second Day of October, 1991

*Attest:*

HARRY F. MANBECK, JR.

*Attesting Officer*

*Commissioner of Patents and Trademarks*